US007536818B1

(12) United States Patent
Margiotta

(10) Patent No.: US 7,536,818 B1
(45) Date of Patent: May 26, 2009

(54) MECHANICAL COUPLING ARRANGEMENT BETWEEN INITIATOR AND FIRING PINS

(75) Inventor: Peter A. Margiotta, La Plata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/214,298

(22) Filed: May 28, 2008

(51) Int. Cl.
*F41A 19/57* (2006.01)

(52) U.S. Cl. ..... 42/69.01

(58) Field of Classification Search ..... 42/69.01, 42/70.08

See application file for complete search history.

(56) References Cited

U.S. PATENT DOCUMENTS 3,583,320 A 6/1971 Gawlick et al.
3,718,093 A 2/1973 Milanowski et al.
3,889,601 A * 6/1975 Koehne et al. ..... 102/364
3,992,999 A 11/1976 Chevrier et al.
4,217,828 A 8/1980 Pelousse
4,320,706 A 3/1982 Rusbach
4,406,225 A 9/1983 Backstein et al.
4,420,860 A 12/1983 Chamuel
4,457,232 A 7/1984 Post
4,487,127 A 12/1984 Lübbers
4,509,427 A * 4/1985 Andreoli ..... 102/261
4,662,279 A 5/1987 Popovitch
4,672,762 A * 6/1987 Nilsson ..... 42/70.01
4,991,510 A 2/1991 Lübbers

* cited by examiner

*Primary Examiner*—Stephen M Johnson
(74) *Attorney, Agent, or Firm*—Fredric J. Zimmerman

(57) ABSTRACT

A mechanical coupling arrangement includes first and second pins and a sphere. When coupled, the pins are longitudinally aligned and include partial portions that face one another. The second pin's partial portion includes a recess formed therein that faces the first pin's partial portion. The recess is spherically-shaped to be smaller than a hemisphere. A sphere is ring-staked into the first pin's partial portion and is seated in the recess.

18 Claims, 2 Drawing Sheets

MECHANICAL COUPLING ARRANGEMENT BETWEEN INITIATOR AND FIRING PINS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to mechanically actuated devices, and more particularly to a mechanical coupling arrangement that can be used to mechanically couple an initiator pin to a firing pin in a secure fashion and reliably provide for the separation of the two pins during a firing sequence.

BACKGROUND OF THE INVENTION

Some pyrotechnic devices use a percussion primer to begin the device's ballistic event. Typically, the percussion primer is actuated by a high pressure gas or by a mechanical firing mechanism. In terms of mechanical firing mechanisms, the hook-type sear design is frequently used because of its simplicity and minimal space requirements. A conventional hook-type sear mechanical firing mechanism is shown in its cocked position if FIG. 1 and in its release position in FIG. 2. In both figures, the firing mechanism is referenced generally by numeral 10.

Firing mechanism 10 includes an annular housing 12 that is centrally bored to define two diameters at 13A and 13B to support a firing pin 14 and initiator pin 16 that share a common longitudinal axis with that of the housing's bore 13. A spring 18 is disposed between an outer annular shoulder 12A of housing 12 and an annular flange 14A of firing pin 14. In the cocked position (FIG. 1), spring 18 is slightly compressed to thereby apply opposing forces $F_C$ to flanges 12A and 14A. In this position, spring 18 is held in place as a flange 16A (formed on initiator pin 16) that is larger in diameter than smaller bore 13A abuts housing 12 as shown. Firing pin 14 and initiator pin 16 are locked together by the combination of (i) complementary hooks 14B and 16B, respectively, and (ii) the narrowly-bored region 13A of housing 12 that constrains firing pin 14 and initiator pin 16 from radial movement. In operation, initiator pin 16 is pulled longitudinally in the direction indicated by arrow 20 in FIG. 2. During this process, spring 18 undergoes further compression. Once hook 16B clears narrowly bored region 13A and enters the larger bored region 13B, initiator pin 16 can disengage from firing pin 14. Once this occurs, the force of spring 18 is released and firing pin 14 moves in the direction of arrow 22 to start a ballistic event.

One problem with the hook-type sear design is the fabrication cost associated with the manufacture of hooks that will perform reliably, e.g., not break, not jam together when they are supposed to separate, etc. Conversely, if short cuts are take in the manufacturing process to save money, the result is an unreliable coupling/release assembly. Further, the hook-type design has an inherent weakness since material must be notched out to create the hook.

SUMMARY OF THE INVENTION

Accordingly, it is an object of the present invention to provide a mechanical coupling arrangement.

Another object of the present invention is to provide a mechanical coupling arrangement suitable for use in a mechanical firing device.

Other objects and advantages of the present invention will become more obvious hereinafter in the specification and drawings.

In accordance with the present invention, a mechanical coupling arrangement includes first and second pins and a sphere. The arrangement is particularly useful in a mechanical firing mechanism where the first pin is a firing pin and the second pin is an initiator pin. The first pin has a first central longitudinal axis, and has a first partial portion extending longitudinally therefrom. The second pin has a second central longitudinal axis, and has a second partial portion extending longitudinally therefrom and adjacent to the first pin's first partial portion. The second partial portion has a recess formed therein that faces the first partial portion. The recess is spherically-shaped to be smaller than a hemisphere. A sphere is ring-staked into the first partial portion and is seated in the recess such that the first longitudinal axis is aligned with the second longitudinal axis.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
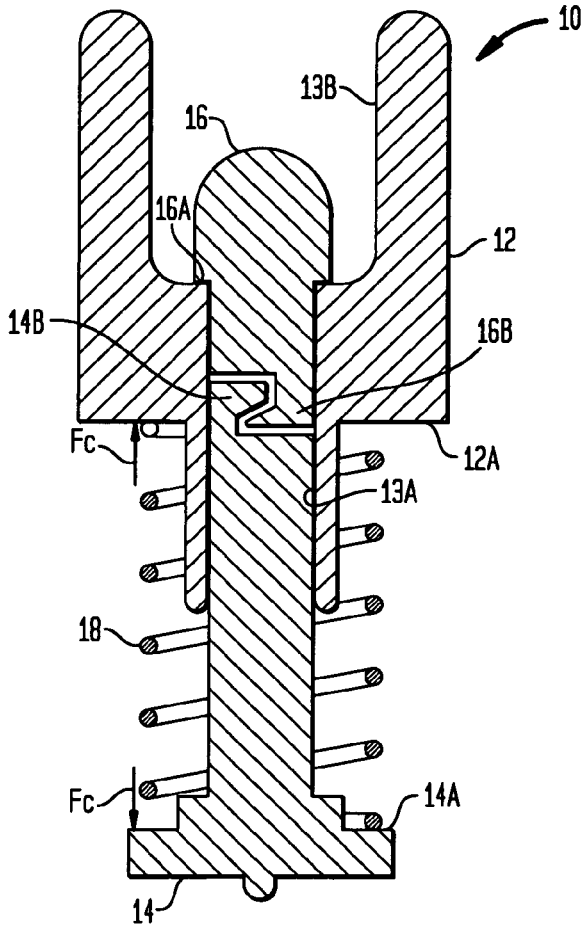
FIG. 1 (PRIOR ART)
FIG. 1 is a cross-sectional view of a conventional mechanical firing mechanism in its cocked position.
Figure 2:
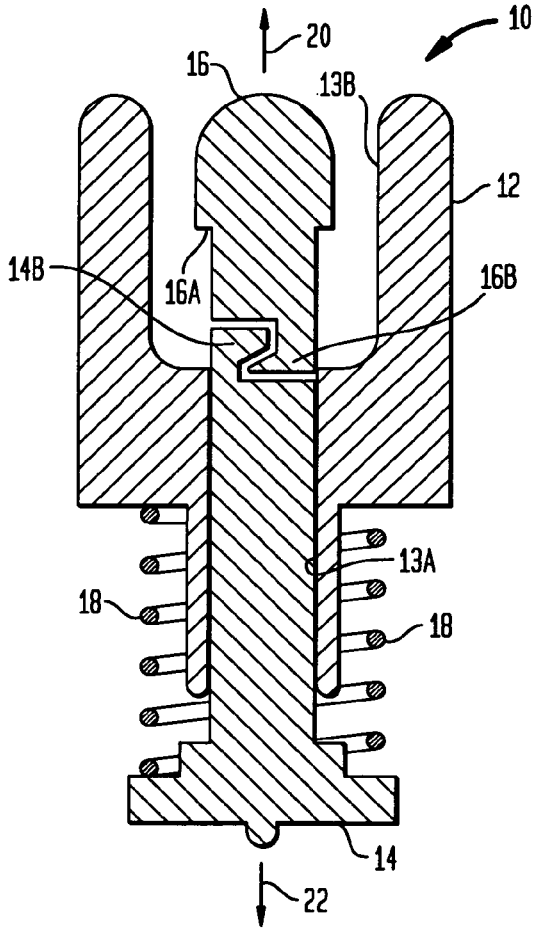
FIG. 2 (PRIOR ART)
FIG. 2 is a cross-sectional view of the conventional mechanical firing mechanism in its released position.
Figure 3:
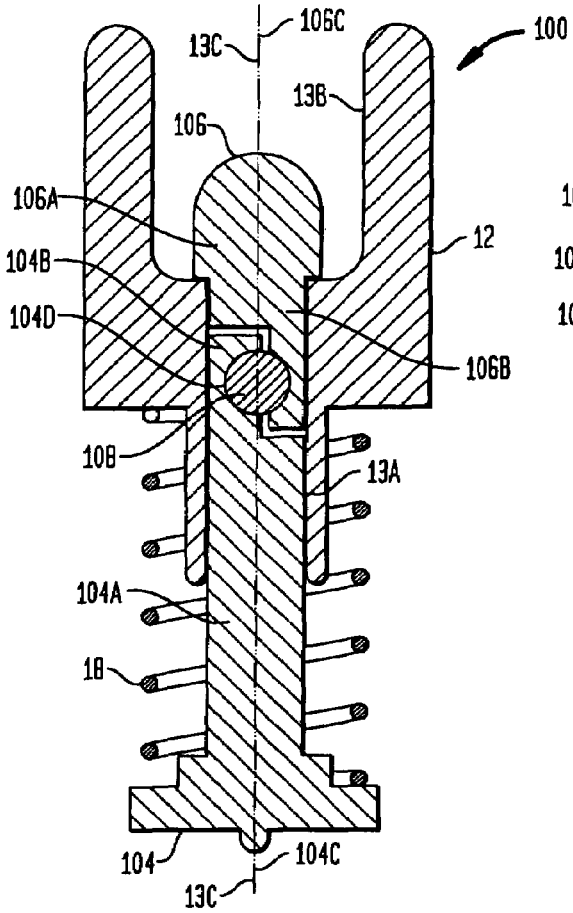
FIG. 3 is a cross-sectional view of a mechanical firing mechanism in its cocked position using an embodiment of the novel mechanical coupling arrangement of the present invention.
Figure 4:
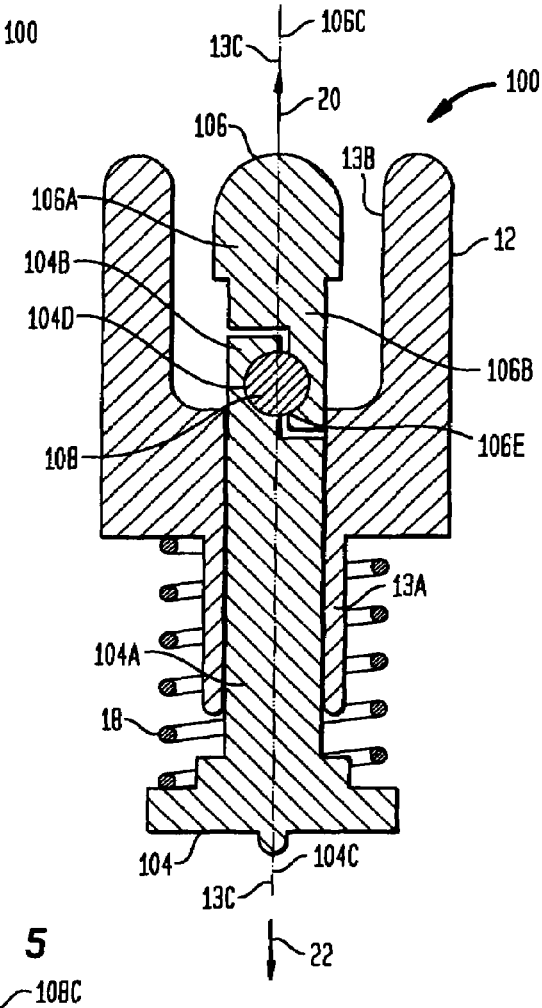
FIG. 4 is a cross-sectional view of the mechanical firing mechanism in its released position using the novel mechanical arrangement of the present invention.

Referring again to the drawings, simultaneous reference will be made to FIGS. 3 and 4 where the novel mechanical coupling arrangement of the present invention is illustrated in the context of a mechanical firing mechanism 100 that performs the same function as firing mechanism 10 (FIGS. 1 and 2) described above. Since housing 12/bore 13 and spring 18 are common between firing mechanism 10 and firing mechanism 100, FIGS. 3 and 4 will use the same reference numerals for these elements and a description thereof will not be repeated.

At the heart of firing mechanism 100 is a firing pin 104, an initiator pin 106, and ball 108. Each of these three elements is made from a rigid material such as a metal. Briefly, ball 108 mechanically couples firing pin 104 to initiator pin 106 in bored region 13A as the ball 108 is intermediate the firing pin 104 and the initiator pin 106 so as to be in contact with the firing pin 104 and the initiator pin 106, and facilitates the uncoupling of initiator pin 106 from firing pin 104 in larger bored region 13B. The structure and relationships between these three elements will now be described with additional reference to FIG. 5 where needed.

Firing pin 104 has a main body 104A sized for sliding engagement with bored region 13A, and an extension 104B that extends longitudinally from main body 104A while only partially filling bored region 13A. Main body 104A has a central longitudinal axis 104C that is coaxially aligned with the central longitudinal axis 13C of bore 13. Extension 104B has a recess 104D (also shown in FIG. 5) that is sized to receive and hold ball 108 therein. More specifically, recess 104D is sized/shaped such that it ring-stakes ball 108 in extension 104B. In an exemplary embodiment, that is, recess 104D defines a partial spherical region that is larger than a hemisphere so that the center 108A of ball 108 resides in recess 104D. If desired, ball 108 may be rigidly coupled to recess 104D using adhesive. As a result, a portion 108B of ball 108 (that is smaller than a hemisphere) is exposed when ball 108 is ring-staked in extension 104B.

Initiator pin 106 also has a main body 106A sized for sliding engagement with bored region 13A, and an extension 106B that extends longitudinally from main body 106A while only partially filling bored region 13A. Main body 106A has a central longitudinal axis 106C that is coaxially aligned with longitudinal axes 13C/104C when main body 106A is in bored region 13A. Extension 106B is sized/shaped to oppose extension 104B. Extension 106B has a recess 106D formed therein that opposes recess 104D and is sized/shaped to allow some portion of exposed portion 108B to seat therein, in an exemplary complementary fashion. In an exemplary embodiment, the ball 108 is simultaneously seated in recess 104D and opposed recess 106D. The amount of exposed portion 108B that seats in recess 106D defines a contact angle θ that will be explained with reference to FIG. 5.

Figure 5:
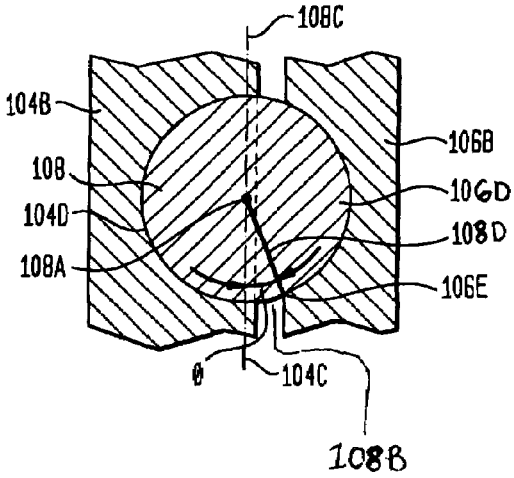
FIG. 5 is an isolated view of a ball ring-staked in the firing pin illustrating geometrical relationships important to the present invention.

In the present invention, the contact angle θ is defined between the following two lines: (i) a central axis 108C of ball 108 that is parallel to or coincident with (as shown) longitudinal axis 104C, and (ii) a line 108D between center 108A of ball 108 and the starting edge 106E of recess 106D. For reasons that will be explained further below, contact angle θ is, in an exemplary embodiment, in the range of approximately 10° to approximately 20°. Note that choosing a contact angle in this range can result in extensions 104B and 106B abutting one another (FIGS. 3 and 4), or a gap being formed between extensions 104B and 106B (FIG. 5). Either option is acceptable and does not depart from the scope of the present invention.

Operation of firing mechanism 100 is similar to the operation of firing mechanism 10. Briefly, initiator pin 106 is pulled longitudinally in the direction indicated by arrow 20 in FIG. 4 to thereby further compress spring 18. Once extension 106B clears bored region 13A and enters bored region 13B, initiator pin 106 is free to more radially and disengages from ball 108 thereby allowing the force of spring 18 to be released so that firing pin 104 can move in the direction of arrow 22 to start a ballistic event. The above-described small contact angle (i.e., between approximately 10-20°) will insure that extension 106B/initiator pin 106 will slide away from ball 108 as extension 106B enters bored region 13B.

The advantages of the present invention are numerous. The precision, hardness and surface finish required for reliable release of a coupling arrangement is provided by a hard ball. Since precision ball bearings are readily available, the mechanical coupling arrangement of the present invention can provide reliability and low cost. Further, the receiving spherical recesses in the initiator and firing pins are easy to machine and will not cause the inherent weakness generated by the notches in the current hook-type sear design.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about" or "approximately") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

The invention claimed is:

1. A mechanical coupling arrangement, comprising:

a first pin including a first central longitudinal axis, said first pin comprises a first partial portion extending longitudinally therefrom;

a second pin including a second central longitudinal axis, said second pin comprising a second partial portion extending longitudinally therefrom and adjacent to said first partial portion, said second partial portion having a recess formed therein that faces said first partial portion, said recess being spherically-shaped and smaller than a hemisphere; and a sphere being ring-staked into said first partial portion and seated in said recess, wherein said first longitudinal axis is aligned with said second longitudinal axis.

2. The mechanical coupling arrangement as in claim 1, wherein a central longitudinal axis of said sphere is aligned with said first longitudinal axis and said second longitudinal axis when said sphere is seated in said recess.

3. The mechanical coupling arrangement as in claim 1, wherein said first partial portion and said second partial portion abut one another when said sphere is seated in said recess.

4. The mechanical coupling arrangement as in claim 1, wherein said first partial portion and said second partial portion are spaced apart from one another when said sphere is seated in said recess.

5. The mechanical coupling arrangement as in claim 1, wherein said sphere forms a complementary fit with said recess.

6. A mechanical coupling arrangement, comprising:

a first pin including a first central longitudinal axis, said first pin comprises a first partial portion extending longitudinally therefrom and further comprises a first recess formed therein, said first recess being shaped to define a portion of a spherical region that is larger than a hemisphere;

a second pin including a second central longitudinal axis, said second pin comprises a second partial portion extending longitudinally therefrom and adjacent to said first partial portion, said second partial portion includes a second recess formed therein that opposes said first recess, said second recess is shaped to define a portion of a spherical region that is smaller than a hemisphere; and a ball being simultaneously seated in said first recess and said second recess, wherein the center of said ball resides in said first recess and said first longitudinal axis is aligned with said second longitudinal axis, wherein an angle is formed between a central axis of said ball that is parallel to said first longitudinal axis and a line defined between the center of said ball and an edge of said second recess, and wherein said angle is selected from the range of approximately 10°-20°.

7. The mechanical coupling arrangement as in claim 6, wherein a central longitudinal axis of said ball is aligned with said first longitudinal axis and said second longitudinal axis when said ball is seated in said first recess and said second recess.

8. The mechanical coupling arrangement as in claim 6, wherein said first partial portion and said second partial portion abut one another when said ball is seated in said first recess and said second recess.

9. The mechanical coupling arrangement as in claim 6, wherein said first partial portion and said second partial portion are spaced apart from one another when said ball is seated in said first recess and said second recess.

10. The mechanical coupling arrangement as in claim 6, wherein said ball is rigidly coupled to said first partial portion.

11. The mechanical coupling arrangement as in claim 6, wherein said ball forms a complementary fit with each of said first recess and said second recess.

12. A mechanical coupling arrangement, comprising:

a firing pin including a first central longitudinal axis, said firing pin comprises a portion thereof extending longitudinally therefrom with a first recess formed therein, said first recess is shaped to define a portion of a spherical region that is larger than a hemisphere;

an initiator pin including a second central longitudinal axis, said initiator pin comprises a portion thereof extending longitudinally therefrom and adjacent to said portion of said firing pin, said portion of said initiator pin comprises a second recess formed therein that opposes said first recess, said second recess is shaped to define a portion of a spherical region that is smaller than a hemisphere;

a ball being simultaneously seated in said first recess and said second recess to thereby form a coupled relationship between said firing pin and said initiator pin wherein the center of said ball resides in said first recess and said first longitudinal axis is aligned with said second longitudinal axis, wherein said second recess is sized such that an angle is formed between a central axis of said ball that is parallel to said first longitudinal axis and a line defined between the center of said ball and an edge of said second recess, and wherein said angle is in the range of approximately 10°-20°; and a housing defining a first region and a second region in coaxial alignment with one another, said first region maintains said coupled relationship and said second region permits dissolution of said coupled relationship.

13. The mechanical coupling arrangement as in claim 12, wherein a central longitudinal axis of said ball is aligned with said first longitudinal axis and said second longitudinal axis when said ball is seated in said first recess and said second recess.

14. The mechanical coupling arrangement as in claim 12, wherein said portion of said firing pin abuts said portion of said initiator pin when said ball is seated in said first recess and said second recess.

15. The mechanical coupling arrangement as in claim 12, wherein said portion of said firing pin is spaced apart from said portion of said initiator pin when said ball is seated in said first recess and said second recess.

16. The mechanical coupling arrangement as in claim 12, wherein said ball is rigidly coupled to said portion of said firing pin.

17. The mechanical coupling arrangement as in claim 12, wherein said ball forms a complementary fit with each of said first recess and said second recess.

18. The mechanical coupling arrangement as in claim 12, wherein said first and second regions of said housing define first and second coaxial bores, respectively, and;

Wherein said second coaxial bore includes a diameter that is greater than that of said first coaxial bore.

* * * * *